US005464133A

United States Patent [19]

Drummond

[11] Patent Number: 5,464,133

[45] Date of Patent: Nov. 7, 1995

[54] LIQUID CONTAINER HAVING A REMOTELY CLEAVABLE SEAL

[76] Inventor: James T. Drummond, 3007 Euclid Ave., San Diego, Calif. 92105

[21] Appl. No.: 301,498

[22] Filed: Sep. 6, 1994

[51] Int. Cl.[6] ..... B65D 47/10

[52] U.S. Cl. ..... 222/484; 215/232; 215/303; 222/510; 222/541.1

[58] Field of Search ..... 222/83, 484, 510, 222/541; 141/21; 215/232, 303

[56] References Cited

U.S. PATENT DOCUMENTS

| | | | |
|---|---|---|---|
| 4,162,747 | 7/1979 | Graf | 222/510 X |
| 4,249,678 | 2/1981 | Pombo | 222/510 X |
| 4,513,883 | 4/1985 | Melzi et al. | 222/484 X |
| 4,739,861 | 4/1988 | Desjardins | 222/83 X |
| 4,953,706 | 9/1990 | Piccard | 222/83 X |
| 5,072,762 | 12/1991 | Jimenez | 222/83 X |
| 5,076,474 | 12/1991 | Hansen | 222/541 X |
| 5,123,570 | 6/1992 | Dubow et al. | 222/83 |
| 5,356,042 | 10/1994 | Huffman et al. | 222/510 X |

FOREIGN PATENT DOCUMENTS

| | | | |
|---|---|---|---|
| 426815 | 4/1935 | United Kingdom | 222/510 |
| 599657 | 3/1948 | United Kingdom | 222/510 |

*Primary Examiner*—Kevin P. Shaver
*Attorney, Agent, or Firm*—Thomas J. Tighe

[57] ABSTRACT

A disposable container for liquids having a remotely cleavable seal allowing the liquids to be poured into an inlet spout, such as an oil inlet for an engine, without spilling. The container having a shell, a spout with a mouth defined by the container at its top from which liquid therein is poured, a membrane sealing the mouth, a membrane cap threadably attached to the spout to protect the membrane, a method for cleaving the seal, consisting of a rod internal to the shell and attached to the membrane at one end and to a vent cap at the other end which is threadably attached to a vent defined by the container at its bottom, remote from the seal and recessed from the load bearing surface to prevent inadvertent rupture of the seal. In use, the membrane cap is removed and the pouring spout is inserted into an inlet opening, the vent cap is twisted causing the attached internal rod to twist, rupturing the membrane seal, and also opening an air vent allowing the liquid to pour smoothly out of the container.

7 Claims, 4 Drawing Sheets

LIQUID CONTAINER HAVING A REMOTELY CLEAVABLE SEAL

BACKGROUND OF THE INVENTION

This invention relates in general to liquid containers having a mouth, sealed by a cleavable seal, from which liquid contained therein is poured, and in particular to such containers having a device for remotely cleaving the seal when the container is in an inverted position.

Automobile engine lubrication oil is now commonly sold in plastic bottles having a pour spout sealed by a cleavable membrane and a screw-on cap. To dispense the oil the cap is removed and the seal cleaved, i.e. punctured, ripped or otherwise broken. However, there is a problem in pouring the oil from the spout: unless the bottle is substantially inverted, the oil runs down the neck of the spout and drips onto the engine and usually onto the garage floor or other surface upon which the vehicle is standing, and generally creates a mess. Moreover the bottles have no air vent to relieve the vacuum created by the exiting oil, and so the oil being poured from the spout pulsates which further exacerbates the spillage problem.

The prior art shows a number of containers aimed at solving the spillage problem.

Dubow et al. U.S. Pat. No. 5,123,570 describes a device for breaking an oil bottle seal by pressing upon a spot on the bottom of the bottle. Pressing on the spot pushes a shaft which runs the length of the bottle to the bottle neck. At that end of the shaft is a cutting head which cuts the seal. However, the seal can be broken if the bottom of the bottle is impacted inadvertently, as by being dropped, Also an air vent is not opened.

Piccard U.S. Pat. No. 4,953,706 describes a variation of the Dubow et al. device. A cutting head is made to break the seal at the mouth of the bottle by squeezing the sides of the bottle. FIGS. 1 and 2 show alternate embodiments of the mechanisms by which the cutting head is forced against the seal whenever the bottle is squeezed. However, the seal could be untimely broken by inadvertent impact of the sides of the bottle, and an air vent is not opened.

Melzi et al. U.S. Pat. No. 4,513,883 describes an oil can having break-open tabs at the top and bottom. Opening the can by either pressing the top tab inward or pulling it outward transfers mechanical force to the bottom tab causing it to open. The mechanical force is transferred by a rod extending diagonally through the interior of the can. Opening the top tab also provides an air vent. However, the bottom tab could be opened inadvertently by inadvertently impacting the top tab. Melzi in fact addresses this problem by having a rod which gives slightly (see FIGS. 5 and 6 showing plunger rod segment 44).

Desjardins U.S. Pat. No. 4,739,861 describes an oil can adapter. It is basically a cup with a piercing rod in the center. An oil can is inserted into the cup and is pierced by the rod so that the oil flows into the cup. The oil can is apparently removed and the piercing rod is then turned which creates a gap at the base of the cup for the oil to flow through into the engine.

Jimenez U.S. Pat. No. 5,072,762 describes a device for puncturing the seal of an oil bottle, particularly when the bottle is inverted. A winged adapter with an internal seal piercing blade is rotated until internal cams ride along vertical slots in the neck of the bottle. When pressure is applied to the wings, the blade pierces the seal and the oil can then escape.

Among other advantages, this invention has the very significant advantage that the seal will not inadvertently break if the bottle is dropped or otherwise impacted, i.e. by mishandling. It also has the advantage that an air vent for smoother pouring is opened along with the cleaving of the seal. Other advantages and attributes of this invention will be readily discernable upon a reading of the text hereinafter.

SUMMARY OF THE INVENTION

An object of this invention is to provide a liquid container with a sealed mouth having a mechanism for remotely cleaving the seal, especially when the container is inverted, i.e. the sealed mouth is facing downwardly.

A further object of this invention is to provide a liquid container with a sealed mouth having a mechanism for remotely cleaving the seal in which the seal is not broken until a twisting force is applied to the mechanism.

A further object of this invention is to provide a liquid container with a sealed mouth having a mechanism for cleaving the seal by a twisting force applied at a place remote from the mouth, the same twisting force used to remove an ambient atmosphere vent cap.

A further object of this invention is to provide a liquid container with a sealed mouth having a mechanism for remotely cleaving the seal in which the seal will not be broken by impacting the container.

These and other objects, which will be seen upon a reading of the specification, are achieved by a container having a shell, a mouth defined by the container from which liquid therein is poured, a seal closing the mouth, a device for cleaving the seal when the device is twisted, and a torque transferring mechanism for twisting the cleaving device from a place remote from the mouth, e.g. at an end of the container opposite the end at which the mouth is located. Preferably the torque transferring mechanism is connected to a vent cap that is removed by manually twisting, i.e. unscrewing, it. In this way the torque transferring mechanism receives torque when the vent cap is opened.

DESCRIPTION OF THE PREFERRED EMBODIMENT

Figure 1:
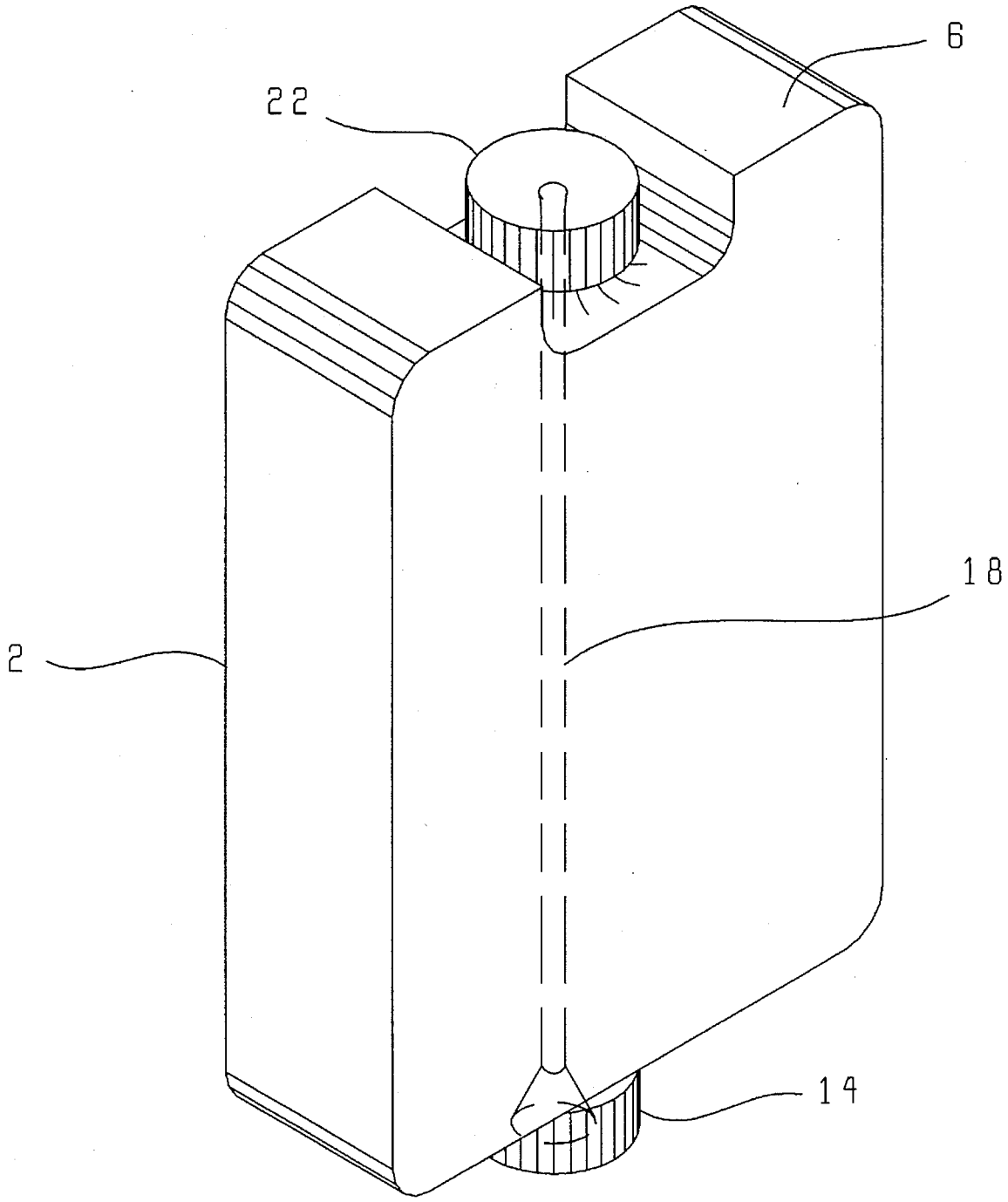
FIG. 1 a pictorial view of a container according to this invention the inverted "pouring" position.
Figure 2:
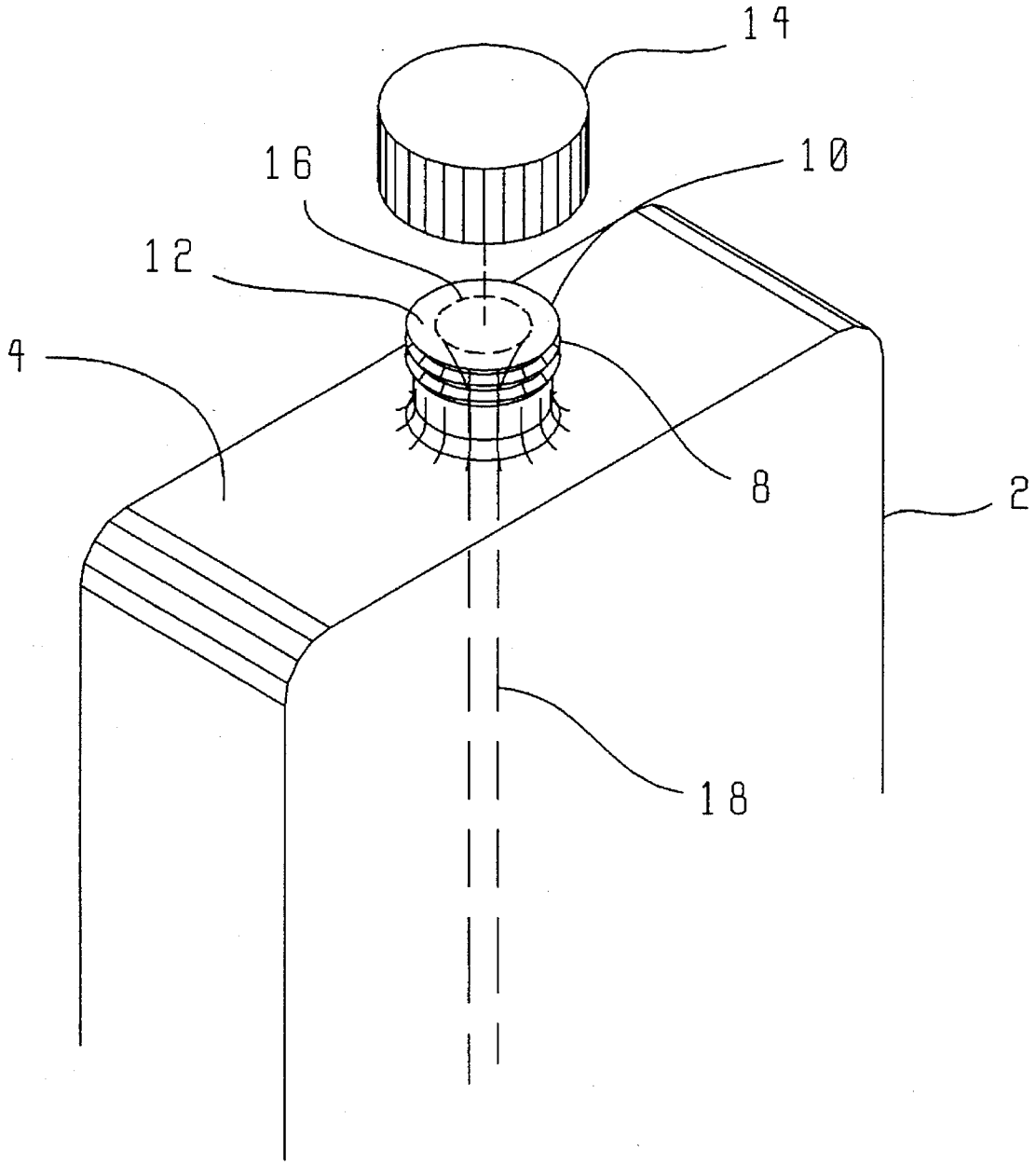
FIG. 2 is a partial perspective exploded view showing the top of the container with the cap removed to reveal a membrane seal covering the mouth of a pour spout.
Figure 3:
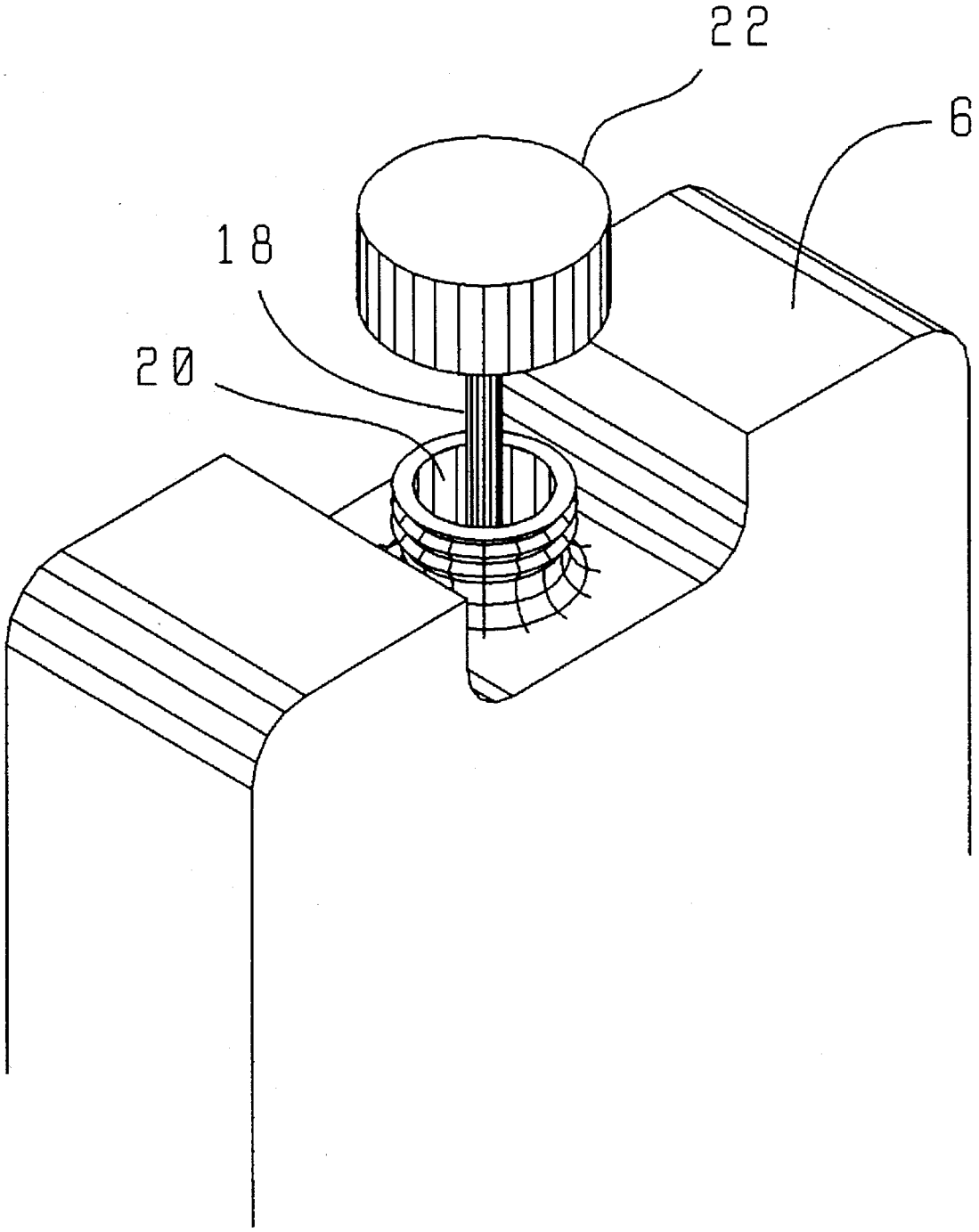
FIG. 3 is a partial perspective view of a container in the pouring position showing the bottom of the container with a bottom cap removed to reveal an inner shaft and an air vent.
Figure 4:
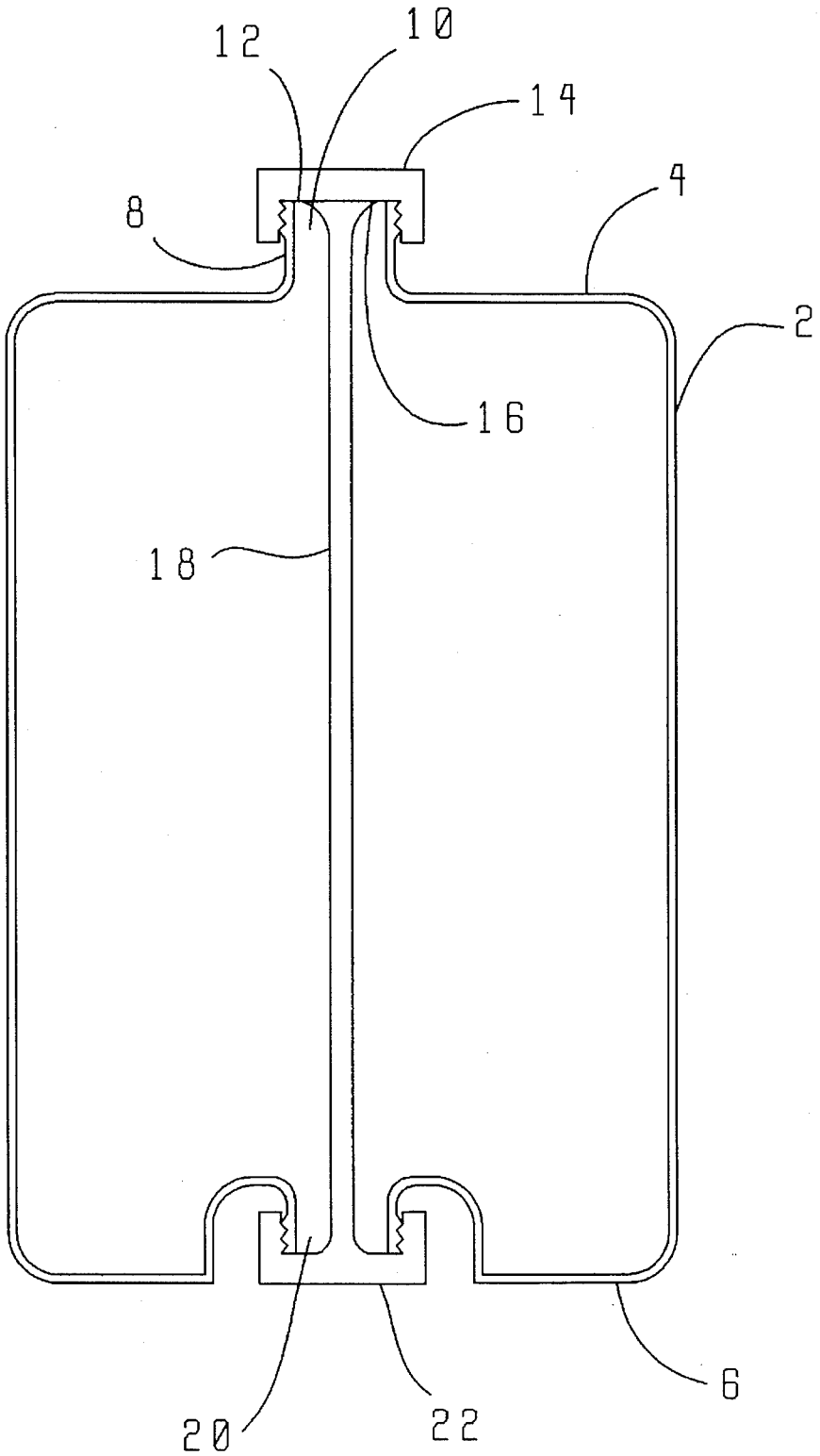
FIG. 4 is a cross-sectional view of an upright container taken along a median from side to side.

Referring to the figures, an embodiment of a container according to this invention is illustrated as having a shell 2 for containment of a liquid. The shell has a top 4 which is the side of the bottle that is normally upright as for storage, and a bottom 6 which is the side upon which the shell normally rests, again as for storage. Protruding from the top of the shell is a pour spout, or neck, 8 which defines a mouth 10. When the container is used to store a liquid for dispensing at a later time, the mouth is sealed by a frangible membrane 12. The membrane and the manner in which it is sealed can be conventional. The membrane is protected from inadvertent puncture by a top cap 14 which is affixed to the neck by threads defined by the neck around the mouth. Disposed inside the neck is a device 16 for cleaving the membrane. Affixed to the cleaving device and running the length of the shell, inside the shell, is a shaft 18. The shaft extends through an air vent 20 defined by the bottom of the shell, and is affixed to a bottom screw cap 22. When the shell is sealed, the bottom screw cap engages threads surrounding the air vent thereby sealing the air vent.

The vent neck and cap are recessed so that the container can sit up right for storage, and to protect the vent neck from inadvertent impacts. The recess helps ensure that if the container is impacted at its bottom, as by being dropped, the impact will be felt primarily by the bottom shoulders, and not the vent neck.

As illustrated, the device 16 for cleaving the membrane is in the form of an inverted cone with the apex rigidly connected to the shaft 18 and the wide end rim of the cone being affixed to the underside of the membrane. Rotating the cone places sufficient stress on the membrane to cause a shear fracture and once a fracture occurs it easily spreads across the membrane. It should be noted, however, that the membrane could also be pre-weakened around the device for easier cleaving.

In operation, the top cap 14 is removed, the shell 2 is inverted and the pour spout, or neck, 8 is inserted into a receptacle for the liquid, such as a mouth of an engine's oil inlet. The membrane 12 at the mouth of the shell is then cleaved by unscrewing the bottom, i.e. air vent, cap 22. This unscrewing action rotates and pulls the shaft to break the pour spout seal. Thus in one action the seal is cleaved and an air vent is opened. It should be seen that since a twisting action is required to cleave the membrane, it is much less susceptible to inadvertent puncture than the membrane of the prior art as described above.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, the described embodiment concerns oil containers, but it should be understood that this invention is not limited to such, but can be used for any kind of liquid.

I claim:

1. A container for liquids comprising:

(a) shell means for containing the liquid;

(b) a mouth defined by the shell means from which liquid therein is poured;

(c) seal means for closing said mouth;

(d) means, when twisted, for cleaving the seal means; and (e) means for twisting the means for cleaving from a place remote from the mouth.

2. The container according to claim 1 wherein the shell means defines a pour spout the open end of which is the mouth, and wherein the seal means comprises a frangible seal affixed to a rim of the mouth.

3. The container according to claim 2 wherein the means for cleaving comprises means, when rotated, for tearing the frangible seal, and wherein the means for twisting comprises:

(a) means, at the place remote from the mouth, for receiving manually applied torque, and (b) means, connected at a first end to the means for tearing and at a second end to the means for receiving torque, for transferring the torque to the means for tearing.

4. The container according to claim 3 wherein the means for transferring the torque is disposed inside the shell and wherein the means for tearing the frangible seal comprises a member affixed to the underside of the frangible seal which when rotated by the means for transferring torque applies at least shearing stress to the seal.

5. The container according to claim 4 further comprising means for opening an ambient atmosphere vent for smoother pouring, and wherein the means for receiving torque comprises vent cap means, removable by unscrewing, for closing the vent, the second end of the means for transferring torque being rigidly affixed to an inside of the vent cap means.

6. The container according to claim 1 further comprising means for opening an ambient atmosphere vent for smoother pouring.

7. A container for liquids comprising:

(a) shell means for containing the liquid;

(b) a mouth defined by the shell means from which liquid therein is poured;

(c) a frangible seal closing the mouth;

(d) a member affixed to the underside of the seal which when rotated cleaves the seal;

(e) an ambient atmosphere vent defined by the shell means at an end of the shell opposite the mouth, (f) a vent cap which when unscrewed opens the vent, (g) a shaft disposed within the shell and rigidly affixed at opposite ends to the member and the vent cap.

* * * * *